US011634848B2

(12) United States Patent
Holzen

(10) Patent No.: US 11,634,848 B2
(45) Date of Patent: Apr. 25, 2023

(54) OPTIMIZED DRYING CYCLE ACROSS A PAIR OF LAUNDRY APPLIANCES

(71) Applicant: Haier US Appliance Solutions, Inc., Wilmington, DE (US)

(72) Inventor: Thomas Holzen, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 51 days.

(21) Appl. No.: 17/319,600

(22) Filed: May 13, 2021

(65) Prior Publication Data

US 2022/0364289 A1 Nov. 17, 2022

(51) Int. Cl.

| | |
|---|---|
| ***D06F 33/70*** | (2020.01) |
| ***D06F 33/60*** | (2020.01) |
| ***D06F 33/40*** | (2020.01) |
| ***D06F 33/44*** | (2020.01) |
| *D06F 103/08* | (2020.01) |
| *D06F 103/38* | (2020.01) |
| *D06F 103/06* | (2020.01) |
| *D06F 105/48* | (2020.01) |

(52) U.S. Cl.

CPC ..... *D06F 33/70* (2020.02); *D06F 33/40* (2020.02); *D06F 33/44* (2020.02); *D06F 33/60* (2020.02); *D06F 2103/06* (2020.02); *D06F 2103/08* (2020.02); *D06F 2103/38* (2020.02); *D06F 2105/48* (2020.02)

(58) Field of Classification Search

CPC ..... D06F 33/60; D06F 33/46; D06F 2105/00; D06F 33/70; D06F 33/44

See application file for complete search history.

(56) References Cited

U.S. PATENT DOCUMENTS

| | | | | |
|---|---|---|---|---|
| 9,447,533 | B2 | 9/2016 | Ashrafzadeh | |
| 10,041,202 | B2 | 8/2018 | De Oliveira | |
| 2013/0160219 | A1* | 6/2013 | Ashrafzadeh | D06F 33/46 68/12.02 |
| 2020/0248356 | A1* | 8/2020 | Kwon | D06F 33/44 |

FOREIGN PATENT DOCUMENTS

WO WO2016206988 A1 12/2016

* cited by examiner

*Primary Examiner* — Joseph L. Perrin
*Assistant Examiner* — Kevin G Lee
(74) *Attorney, Agent, or Firm* — Dority & Manning, P.A.

(57) ABSTRACT

A method of operating a pair of laundry appliances is provided. The pair of laundry appliances includes a washing machine appliance and a dryer appliance. The method includes determining a first moisture extraction curve of a spin cycle of the washing machine appliance and determining a second moisture extraction curve of the dryer appliance. The method further includes rotating a basket of the washing machine appliance at an extraction speed for a predetermined period of time. The predetermined period of time is based on the first moisture extraction curve and the second moisture extraction curve.

18 Claims, 8 Drawing Sheets

OPTIMIZED DRYING CYCLE ACROSS A PAIR OF LAUNDRY APPLIANCES

FIELD OF THE INVENTION

The present subject matter relates generally to laundry appliances, and more particularly to laundry appliances with optimized drying operations.

BACKGROUND OF THE INVENTION

Various laundry appliances include features for drying articles therein. For example, dryer appliances are typically paired with a separate washing machine appliance such that wet articles from the washing machine appliance may be loaded into the paired dryer appliance for drying.

The washing machine appliance typically provides a spin cycle, such as at a final stage of a wash operation, to extract some moisture from the articles prior to loading the articles into the paired dryer. The moisture extraction rate decreases over time during the spin cycle of the washing machine appliance. As a result, extended spin cycles may provide diminishing returns and may result in an overly long total drying time between the washing machine appliance and the dryer appliance.

Accordingly, paired laundry appliances having improved features for adapting moisture extraction operations, e.g., including a spin cycle in the washing machine appliance and a dry cycle in the dryer appliance, to optimize the total drying time across the pair of laundry appliances would be advantageous.

BRIEF DESCRIPTION OF THE INVENTION

Aspects and advantages of the invention will be set forth in part in the following description, or may be obvious from the description, or may be learned through practice of the invention.

In one aspect of the present disclosure, a method of operating a pair of laundry appliances is provided. The pair of laundry appliances includes a washing machine appliance and a dryer appliance. The method includes determining a first moisture extraction curve of a spin cycle of the washing machine appliance and determining a second moisture extraction curve of the dryer appliance. The method also includes rotating a basket of the washing machine appliance at an extraction speed for a predetermined period of time. The predetermined period of time is based on the first moisture extraction curve and the second moisture extraction curve.

In another aspect of the present disclosure, a pair of laundry appliances is provided. The pair of laundry appliances includes a washing machine appliance and a dryer appliance. The pair of laundry appliances is configured to determine a first moisture extraction curve of a spin cycle of the washing machine appliance and to determine a second moisture extraction curve of the dryer appliance. The pair of laundry appliances is also configured to rotate a basket of the washing machine appliance at an extraction speed for a predetermined period of time. The predetermined period of time is based on the first moisture extraction curve and the second moisture extraction curve.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
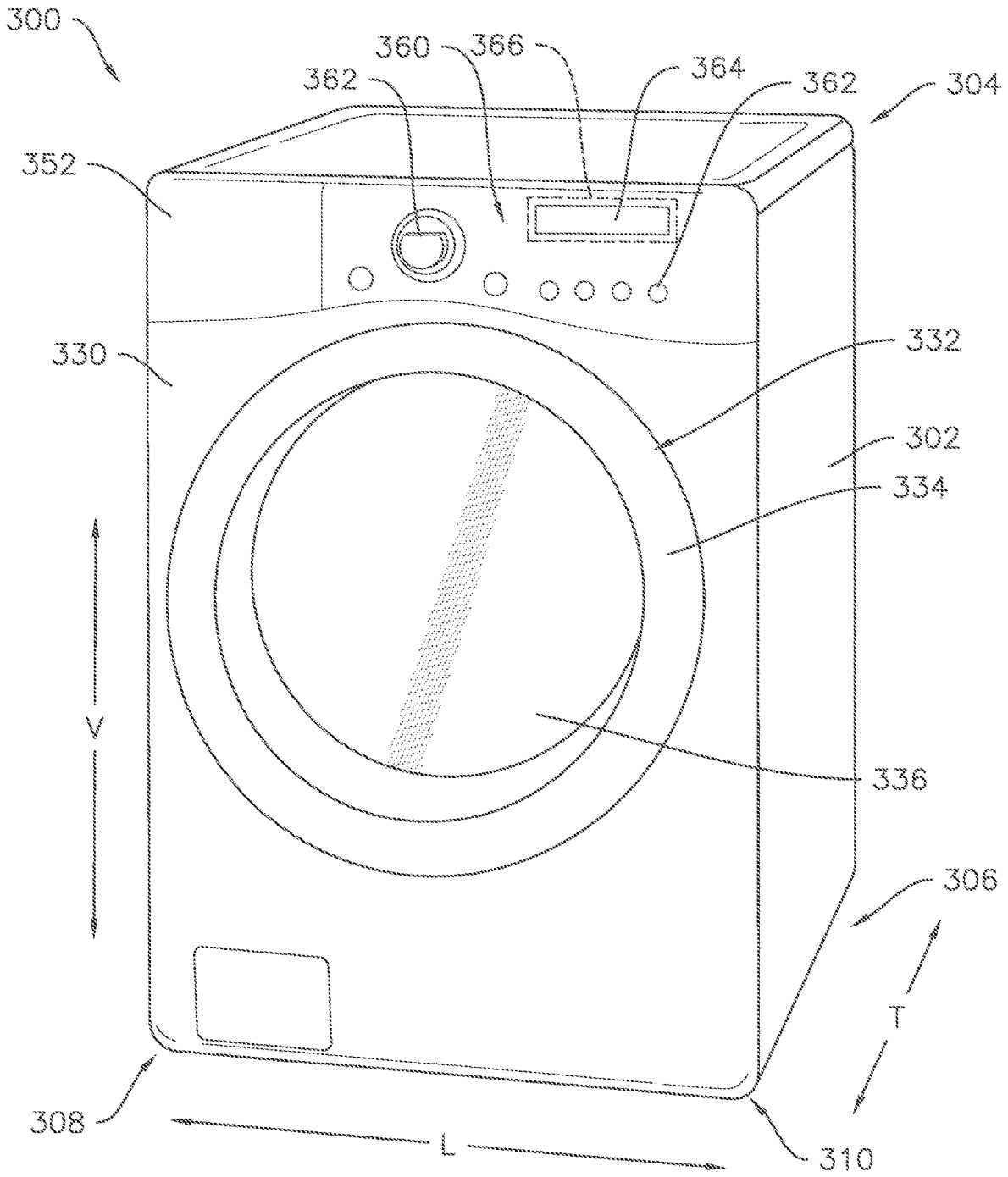
FIG. 1 provides a perspective view of a laundry appliance in accordance with one or more exemplary embodiments of the present disclosure.

Reference now will be made in detail to embodiments of the invention, one or more examples of which are illustrated in the drawings. The detailed description uses numerical and letter designations to refer to features in the drawings. Like or similar designations in the drawings and description have been used to refer to like or similar parts of the disclosure. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "substantially," "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

As used herein, the terms "articles," "clothing," or "laundry" include but need not be limited to fabrics, textiles, garments, linens, papers, or other items which may be cleaned, dried, and/or otherwise treated in a laundry appliance. Furthermore, the term "load" or "laundry load" refers to the combination of clothing that may be washed together in a washing machine appliance or dried together in a dryer appliance (e.g., clothes dryer), including washed and dried together in a combination laundry appliance, and may include a mixture of different or similar articles of clothing of different or similar types and kinds of fabrics, textiles, garments and linens within a particular laundering process.

FIGS. 1 through 4 illustrate an exemplary pair of laundry appliances, e.g., a washing machine appliance (FIGS. 1 and 2) and a dryer appliance (FIGS. 3 and 4), each of which may be one half of a pair of laundry appliances, such as together with the other illustrated example laundry appliance or with any other suitable washing machine appliance or dryer appliance. The laundry appliances may be paired in that they are mated together, e.g., connected, for communication between the appliances, such as wireless transmission and receipt of data and/or signals. Examples of data which may be communicated between the paired laundry appliances are discussed in more detail below. The washing machine appliance and the dryer appliance may also be paired in that they form a matched set which may be sold and/or used together. For example, the washing machine appliance and the dryer appliance may be located proximate to or next to each other, such as in the same room, e.g., laundry room or laundromat, for washing a load in the washing machine appliance that is then transferred to the dryer appliance for drying the load therein.

Figure 2:
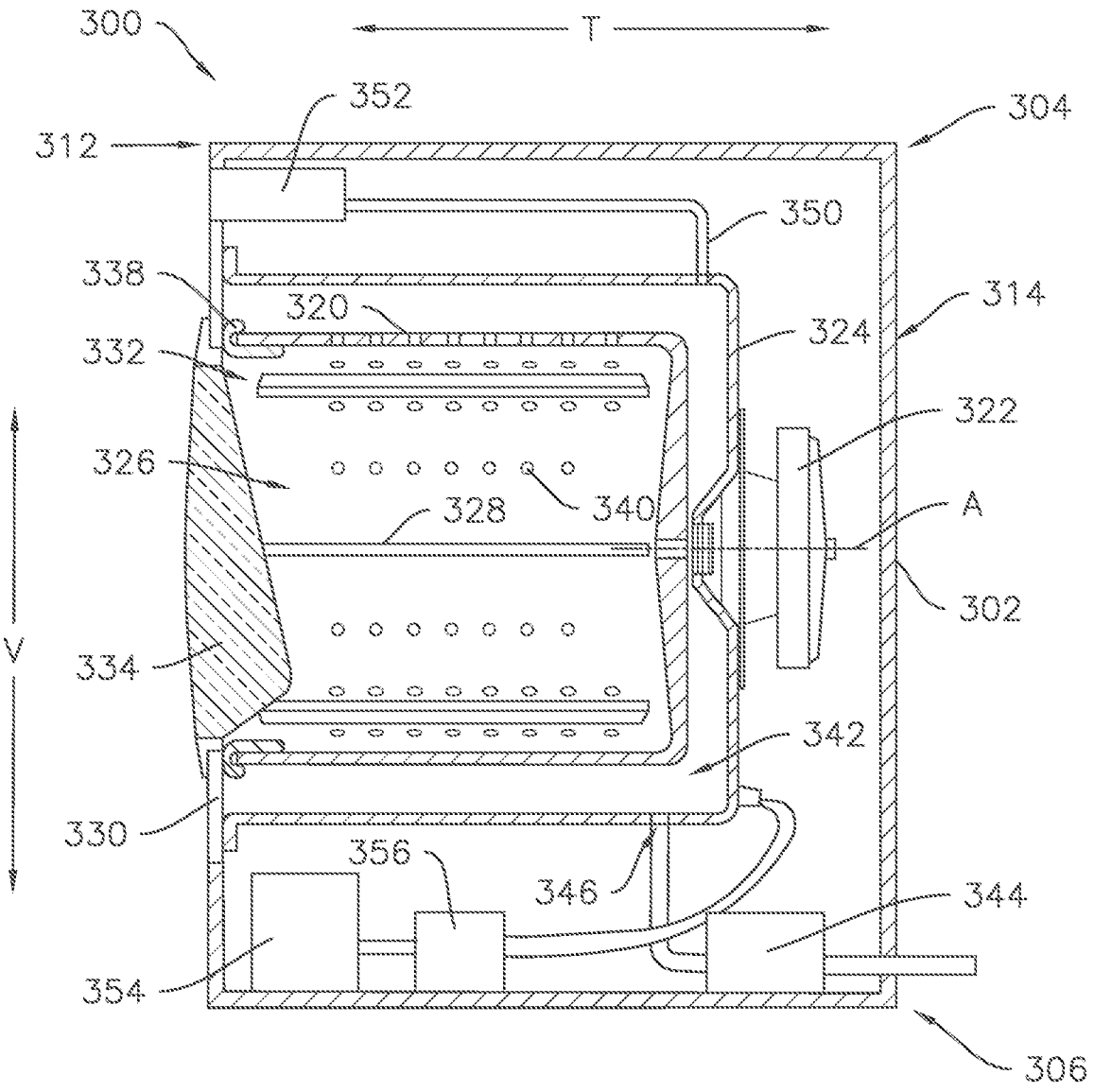
FIG. 2 provides a cross-section view of the example laundry appliance of FIG. 1.

FIG. 1 provides a perspective view of a laundry appliance 300 according to exemplary embodiments of the present disclosure. In particular, the exemplary laundry appliance illustrated in FIG. 1 is an exemplary horizontal axis washing machine appliance 300. FIG. 2 is a side cross-sectional view of washing machine appliance 300 according to one example embodiment. As illustrated, washing machine appliance 300 generally defines a vertical direction V, a lateral direction L, and a transverse direction T, each of which is mutually perpendicular, such that an orthogonal coordinate system is generally defined. Washing machine appliance 300 includes a cabinet 302 that extends between a top 304 and a bottom 306 along the vertical direction V, between a left side 308 and a right side 310 along the lateral direction L, and between a front 312 and a rear 314 along the transverse direction T.

As may be seen in FIG. 2, a wash tub 324 is positioned within cabinet 302 and is generally configured for retaining wash fluids during an operating cycle. As used herein, "wash fluid" may refer to water, detergent, fabric softener, bleach, or any other suitable wash additive or combination thereof. Wash tub 324 is substantially fixed relative to cabinet 302 such that it does not rotate or translate relative to cabinet 302.

A wash basket 320 is received within wash tub 324 and defines a wash chamber 326 that is configured for receipt of articles for washing. More specifically, wash basket 320 is rotatably mounted within wash tub 324 such that it is rotatable about an axis of rotation A. According to the illustrated embodiment, the axis of rotation is substantially parallel to the transverse direction T. In this regard, washing machine appliance 300 is generally referred to as a "horizontal axis" or "front load" washing machine appliance 300. However, it should be appreciated that aspects of the present subject matter may be used within the context of a vertical axis or top load washing machine appliance as well.

Wash basket 320 may define one or more agitator features that extend into wash chamber 326 to assist in agitation and cleaning of articles disposed within wash chamber 326 during operation of washing machine appliance 300. For example, as illustrated in FIG. 2, a plurality of ribs 328 extends from basket 320 into wash chamber 326. In this manner, for example, ribs 328 may lift articles disposed in wash basket 320 during rotation of wash basket 320.

Washing machine appliance 300 includes a motor assembly 322 that is in mechanical communication with wash basket 320 to selectively rotate wash basket 320 (e.g., during an agitation or a rinse cycle of washing machine appliance 300). According to the illustrated embodiment, motor assembly 322 is a pancake motor. However, it should be appreciated that any suitable type, size, or configuration of motor may be used to rotate wash basket 320 according to alternative embodiments.

Referring generally to FIGS. 1 and 2, cabinet 302 also includes a front panel 330 that defines an opening 332 that permits user access to wash basket 320 of wash tub 324. More specifically, washing machine appliance 300 includes a door 334 that is positioned over opening 332 and is rotatably mounted to front panel 330 (e.g., about a door axis that is substantially parallel to the vertical direction V). In this manner, door 334 permits selective access to opening 332 by being movable between an open position (not shown) facilitating access to a wash tub 324 and a closed position (FIG. 1) prohibiting access to wash tub 324.

In some embodiments, a window 336 in door 334 permits viewing of wash basket 320 when door 334 is in the closed position (e.g., during operation of washing machine appliance 300). Door 334 also includes a handle (not shown) that, for example, a user may pull when opening and closing door 334. Further, although door 334 is illustrated as mounted to front panel 330, it should be appreciated that door 334 may be mounted to another side of cabinet 302 or any other suitable support according to alternative embodiments. Additionally or alternatively, a front gasket or baffle 338 may extend between tub 324 and the front panel 330 about the opening 332 covered by door 334, further sealing tub 324 from cabinet 302.

As illustrated for example in FIG. 2, wash basket 320 may also include a plurality of perforations 340 extending therethrough in order to facilitate fluid communication between an interior of basket 320 and wash tub 324. A sump 342 is defined by wash tub 324 at a bottom of wash tub 324 along the vertical direction V. Thus, sump 342 is configured for receipt of, and generally collects, wash fluid during operation of washing machine appliance 300. For example, during operation of washing machine appliance 300, wash fluid may be urged (e.g., by gravity) from basket 320 to sump 342 through the plurality of perforations 340. A pump assembly 344 is located beneath wash tub 324 for gravity assisted flow when draining wash tub 324 (e.g., via a drain 346). Pump assembly 344 is also configured for recirculating wash fluid within wash tub 324.

In some embodiments, washing machine appliance 300 includes an additive dispenser or spout 350. For example, spout 350 may be in fluid communication with a water supply (not shown) in order to direct fluid (e.g., clean water) into wash tub 324. Spout 350 may also be in fluid communication with the sump 342. For example, pump assembly 344 may direct wash fluid disposed in sump 342 to spout 350 in order to circulate wash fluid in wash tub 324.

As illustrated, a detergent drawer 352 may be slidably mounted within front panel 330. Detergent drawer 352 receives a wash additive (e.g., detergent, fabric softener, bleach, or any other suitable liquid or powder) and directs the fluid additive to wash chamber 326 during operation of washing machine appliance 300. According to the illustrated embodiment, detergent drawer 352 may also be fluidly coupled to spout 350 to facilitate the complete and accurate dispensing of wash additive.

In optional embodiments, a bulk reservoir 354 is disposed within cabinet 302. Bulk reservoir 354 may be configured for receipt of fluid additive for use during operation of washing machine appliance 300. Moreover, bulk reservoir 354 may be sized such that a volume of fluid additive sufficient for a plurality or multitude of wash cycles of washing machine appliance 300 (e.g., five, ten, twenty, fifty, or any other suitable number of wash cycles) may fill bulk reservoir 354. Thus, for example, a user can fill bulk reservoir 354 with fluid additive and operate washing machine appliance 300 for a plurality of wash cycles without refilling bulk reservoir 354 with fluid additive. A reservoir pump 356 is configured for selective delivery of the fluid additive from bulk reservoir 354 to wash tub 324.

A control panel 360 including a plurality of input selectors 362 is coupled to front panel 330. Control panel 360 and input selectors 362 collectively form a user interface input for operator selection of machine cycles and features. For example, in one embodiment, a display 364 indicates selected features, a countdown timer, or other items of interest to machine users.

Operation of washing machine appliance 300 is controlled by a controller or processing device 366 that is operatively coupled to control panel 360 for user manipulation to select washing machine cycles and features. In response to user manipulation of control panel 360, controller 366 operates the various components of washing machine appliance 300 to execute selected machine cycles and features.

Controller 366 may include a memory (e.g., non-transitive memory) and microprocessor, such as a general or special purpose microprocessor operable to execute programming instructions or micro-control code associated with a wash operation. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 366 may be constructed without using a microprocessor (e.g., using a combination of discrete analog or digital logic circuitry, such as switches, amplifiers, integrators, comparators, flip-flops, AND gates, and the like) to perform control functionality instead of relying upon software. Control panel 360 and other components of washing machine appliance 300, such as motor assembly 322, may be in communication with controller 366 via one or more signal lines or shared communication busses. It should be noted that controllers as disclosed herein are capable of and may be operable to perform any methods and associated method steps as disclosed herein. For example, in some embodiments, methods disclosed herein may be embodied in programming instructions stored in the memory and executed by the controller.

In exemplary embodiments, during operation of washing machine appliance 300, laundry items are loaded into wash basket 320 through opening 332, and a wash operation is initiated through operator manipulation of input selectors 362. For example, a wash cycle may be initiated such that wash tub 324 is filled with water, detergent, or other fluid additives (e.g., via spout 350). One or more valves (not shown) can be controlled by washing machine appliance 300 to provide for filling wash basket 320 to the appropriate level for the amount of articles being washed or rinsed. By way of example, once wash basket 320 is properly filled with fluid, the contents of wash basket 320 can be agitated (e.g., with ribs 328) for an agitation phase of laundry items in wash basket 320. During the agitation phase, the basket 320 may be motivated about the axis of rotation A at a set speed (e.g., a tumble speed). As the basket 320 is rotated, articles within the basket 320 may be lifted and permitted to drop therein.

After the agitation phase of the washing operation is completed, wash tub 324 can be drained. Laundry articles can then be rinsed (e.g., through a rinse cycle) by again adding fluid to wash tub 324, depending on the particulars of the cleaning cycle selected by a user. Ribs 328 may again provide agitation within wash basket 320. One or more spin cycles may also be used. In particular, a spin cycle may be applied after the wash cycle or after the rinse cycle in order to wring wash fluid from the articles being washed. During a spin cycle, basket 320 is rotated at relatively high speeds. For instance, basket 320 may be rotated at one set speed (e.g., a pre-plaster speed) before being rotated at another set speed (e.g., a plaster speed). As would be understood, the pre-plaster speed may be greater than the tumble speed and the plaster speed may be greater than the pre-plaster speed. Moreover, agitation or tumbling of articles may be reduced as basket 320 increases its rotational velocity such that the plaster speed maintains the articles at a generally fixed position relative to basket 320.

After articles disposed in wash basket 320 are cleaned (or the washing operation otherwise ends), a user can remove the articles from wash basket 320 (e.g., by opening door 334 and reaching into wash basket 320 through opening 332).

Figure 3:
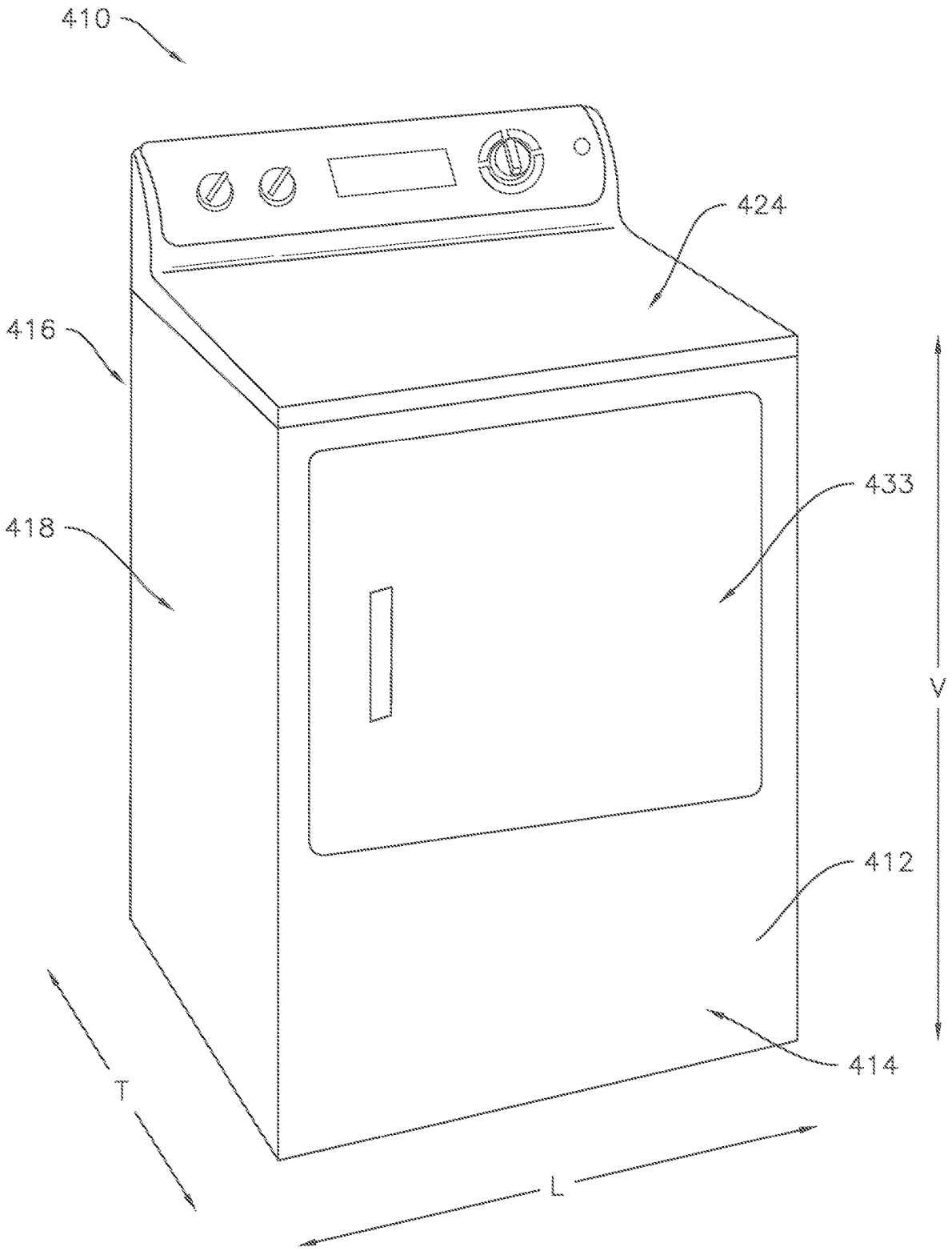
FIG. 3 provides a perspective view of another laundry appliance as may be used with one or more additional exemplary embodiments of the present disclosure.
Figure 4:
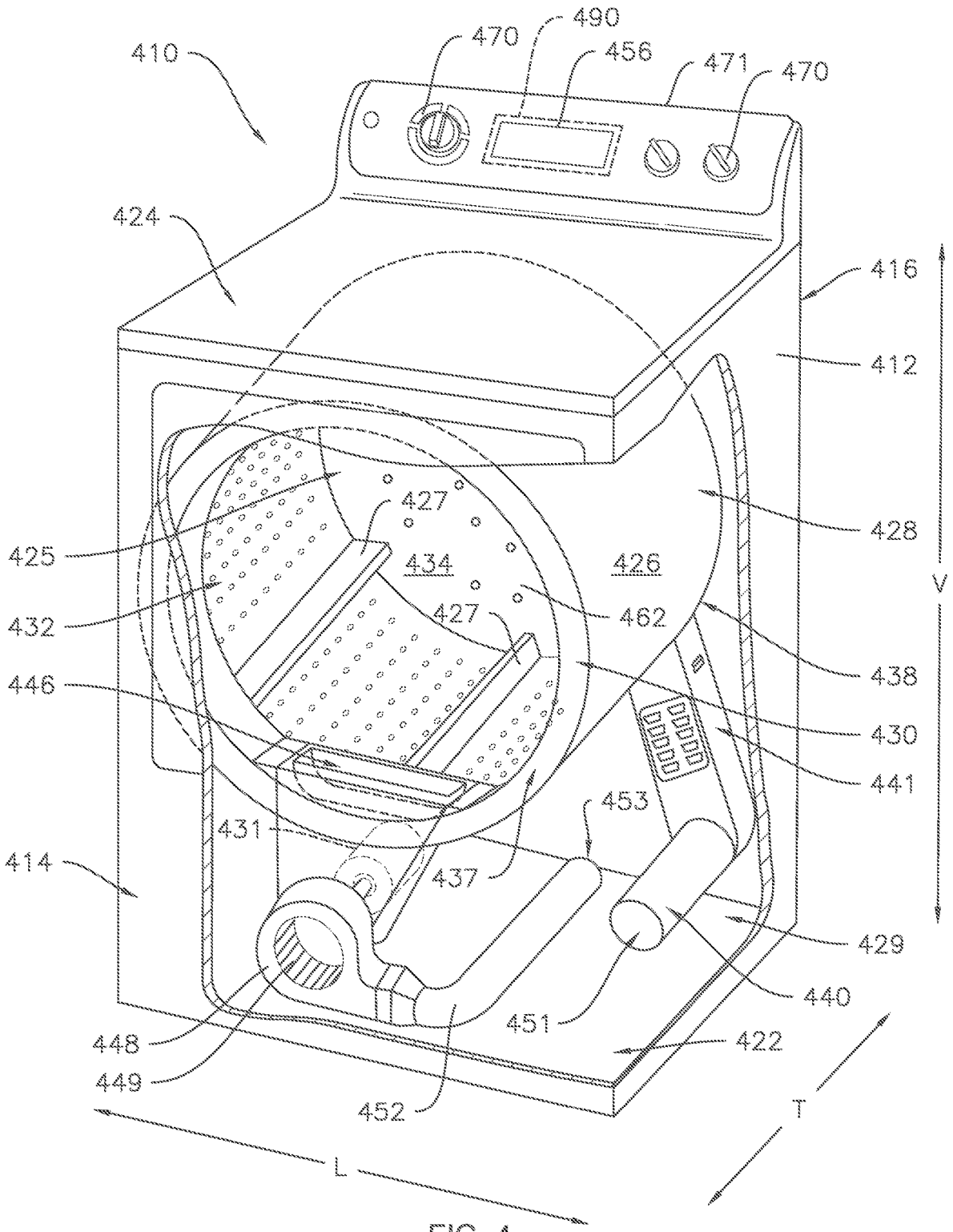
FIG. 4 provides a perspective view of the example laundry appliance of FIG. 3 with portions of a cabinet of the laundry appliance removed to reveal certain components of the laundry appliance.

FIG. 3 provides a perspective view of dryer appliance 410 according to one or more exemplary embodiments of the present disclosure. FIG. 4 provides another perspective view of dryer appliance 410 with a portion of a cabinet or housing 412 of dryer appliance 410 removed in order to show certain components of dryer appliance 410. Dryer appliance 410 generally defines a vertical direction V, a lateral direction L, and a transverse direction T, each of which is mutually perpendicular, such that an orthogonal coordinate system is defined. While described in the context of a specific embodiment of dryer appliance 410, using the teachings disclosed herein, it will be understood that dryer appliance 410 is provided by way of example only. Other dryer appliances having different appearances and different features may also be utilized with embodiments of the present subject matter.

Cabinet 412 includes a front panel 414, a rear panel 416, a pair of side panels 418 and 420 spaced apart from each other by front and rear panels 414 and 416, a bottom panel 422, and a top cover 424. Within cabinet 412, an interior volume 429 is defined. A drum or container 426 is mounted for rotation about a substantially horizontal axis within the interior volume 429. Drum 426 defines a chamber 425 for receipt of articles of clothing for tumbling and/or drying. Drum 426 extends between a front portion 437 and a back portion 438. Drum 426 also includes a back or rear wall 434, e.g., at back portion 438 of drum 426. A supply duct 441 may be mounted to rear wall 434 and receives heated air that has been heated by a heating assembly or system 440.

A motor 431 is provided in some embodiments to rotate drum 426 about the horizontal axis, e.g., via a pulley and a belt (not pictured). Drum 426 is generally cylindrical in shape, having an outer cylindrical wall 428 and a front flange or wall 430 that defines an opening 432 of drum 426, e.g., at front portion 437 of drum 426, for loading and unloading of articles into and out of chamber 425 of drum 426. A plurality of lifters or baffles 427 are provided within chamber 425 of drum 426 to lift articles therein and then allow such articles to tumble back to a bottom of drum 426 as drum 426 rotates. Baffles 427 may be mounted to drum 426 such that baffles 427 rotate with drum 426 during operation of dryer appliance 410.

Drum 426 includes a rear wall 434 rotatably supported within main housing 412 by a suitable fixed bearing. Rear wall 434 can be fixed or can be rotatable. Rear wall 434 may include, for instance, a plurality of holes that receive hot air that has been heated by a heating assembly or system 440, as will be described further below. Motor 431 is also in mechanical communication with an air handler 448 such that motor 431 rotates a fan 449, e.g., a centrifugal fan, of air handler 448. Air handler 448 is configured for drawing air through chamber 425 of drum 426, e.g., in order to dry articles located therein. In alternative example embodiments, dryer appliance 410 may include an additional motor (not shown) for rotating fan 449 of air handler 448 independently of drum 426.

Drum 426 is configured to receive heated air that has been heated by a heating assembly 440, e.g., via holes in the rear wall 434 as mentioned above, in order to dry damp articles disposed within chamber 425 of drum 426. For example, heating assembly 440 may include any suitable heat source, such as a gas burner, an electrical resistance heating element, or heat pump, for heating air. As discussed above, during operation of dryer appliance 410, motor 431 rotates drum 426 and fan 449 of air handler 448 such that air handler 448 draws air through chamber 425 of drum 426 when motor 431 rotates fan 449. In particular, ambient air enters heating assembly 440 via an inlet 451 due to air handler 448 urging such ambient air into inlet 451. Such ambient air is heated within heating assembly 440 and exits heating assembly 440 as heated air. Air handler 448 draws such heated air through supply duct 441 to drum 426. The heated air enters drum 426 through a plurality of outlets of supply duct 441 positioned at rear wall 434 of drum 426.

Within chamber 425, the heated air may accumulate moisture, e.g., from damp clothing disposed within chamber 425. In turn, air handler 448 draws moisture-saturated air through a screen filter (not shown) which traps lint particles. Such moisture-statured air then enters an exit duct 446 and is passed through air handler 448 to an exhaust duct 452. From exhaust duct 452, such moisture-statured air passes out of dryer appliance 410 through a vent 453 defined by cabinet 412. After the clothing articles have been dried, they are removed from the drum 426 via opening 432. A door 433 (FIG. 3) provides for closing or accessing drum 426 through opening 432. The door 433 may be movable between an open position and a closed position, the open position for access to the chamber 425 defined in the drum 426, and the closed position for sealingly enclosing the chamber 425 defined in the drum 426.

In some embodiments, one or more selector inputs 470, such as knobs, buttons, touchscreen interfaces, etc., may be provided or mounted on a cabinet 412 (e.g., on a backsplash 471 of the cabinet 412) and are in operable communication (e.g., electrically coupled or coupled through a wireless network band) with a processing device or controller 490. A display 456 may also be provided on the backsplash 471 and may also be in operable communication with the controller 490. Controller 490 may also be provided in operable communication with motor 431, air handler 448, and/or heating assembly 440. In turn, signals generated in controller 490 direct operation of motor 431, air handler 448, and/or heating assembly 440 in response to the position of inputs 470. In the example illustrated in FIGS. 5 and 6, the inputs 470 are provided as knobs. In other embodiments, inputs 470 may also or instead include buttons, switches, touchpads and/or a touch screen type interface.

Controller 490 is a "processing device" or "controller" and may be embodied as described herein. As used herein, "processing device" or "controller" may refer to one or more microprocessors, microcontrollers, application-specific integrated circuits (ASICS), or semiconductor devices and is not restricted necessarily to a single element. The controller 490 may be programmed to operate dryer appliance 410 by executing instructions stored in memory (e.g., non-transitory media). The controller 490 may include, or be associated with, one or more memory elements such as RAM, ROM, or electrically erasable, programmable read only memory (EEPROM). For example, the instructions may be software or any set of instructions that when executed by the processing device, cause the processing device to perform operations. Controller 490 may include one or more processor(s) and associated memory device(s) configured to perform a variety of computer-implemented functions and/or instructions (e.g. performing the methods, steps, calculations and the like and storing relevant data as disclosed herein). It should be noted that controllers as disclosed herein are capable of and may be operable to perform any methods and associated method steps as disclosed herein. For example, in some embodiments, methods disclosed herein may be embodied in programming instructions stored in the memory and executed by the controller.

In particular, dryer appliance 410 and/or the controller thereof, e.g., controller 490, may be operable to and configured to perform methods as described herein. In some embodiments, the dryer appliance and/or the controller thereof may be coupled to a washing machine appliance, e.g., washing machine appliance 300 described above, such as communicatively coupled for wired or wireless communication, e.g., of drying operation information such as moisture extraction curves to and from the washing machine appliance to and from the dryer appliance.

For example, exemplary methods may include determining the load type of articles in the wash chamber and/or the controller 366 may be configured to determine a load type of articles within wash chamber 326 of basket 320. For example, other exemplary methods of establishing a load type are described in U.S. Pat. No. 9,758,913 to Obregon, the disclosure of which is incorporated herein by reference in its entirety for all purposes.

As used herein, the term "load type" corresponds to a composition or fabric type of articles, e.g., within wash chamber 326 of basket 320. As an example, the load type of such articles may be natural, synthetic, or blended. A natural load type may include entirely or predominantly articles composed of natural fiber fabrics, such as cotton. A synthetic load type may include synthetic articles, such as nylon or polyester articles. If a mixed or blended load of articles is disposed within wash chamber 326 of basket 320, the load type of such articles is a mixed or blended load type. Thus, the blended load type can correspond to a blend of cotton articles and synthetic articles within wash chamber 326 of basket 320.

The load type of articles within wash chamber 326 of basket 320 may be determined at least in part based on mass of the articles and the absorptivity of the articles. For example, natural articles such as cotton articles can have a relatively high absorptivity whereas synthetic articles, such as nylon or polyester articles, can have a relatively low absorptivity. Determining the load type may include rotating basket 320 with motor 322, e.g., by the controller 366. Thus, controller 366 can activate motor 322 in order to rotate basket 320. Controller 366 can operate motor 322 such that basket 320 rotates at a predetermined frequency or angular velocity. The predetermined frequency or angular velocity can be any suitable frequency or angular velocity. For example, the predetermined frequency or angular velocity may be about one hundred and twenty revolutions per minute.

The controller 366 may also adjust an angular velocity of basket 320. Controller 366 can utilize motor 322 to adjust the angular velocity of basket 320. In certain exemplary embodiments, controller 366 can deactivate motor 322 in order to adjust the angular velocity of basket 320. To deactivate motor 322, controller 366 can short windings of motor 322, e.g., using any suitable mechanism or method known to those skilled in the art.

Determining the load type may further include, by the controller 366, determining an angular acceleration or first derivative of the angular velocity of basket 320 or a jerk or a second derivative of the angular velocity of basket 320, e.g., based at least in part the adjustment of the angular velocity of basket 320. Based upon the first and/or second derivative of the angular velocity of basket 320, controller 366 estimates a mass of articles within wash chamber 326 of basket 320. Thus, controller 366 can establish the mass of articles within wash chamber 326 of basket 320 based upon the inertia of articles within wash chamber 326 of basket 320. As an example, the magnitude of the first and/or second derivative of the angular velocity of basket 320 can be inversely proportional to the mass of articles within wash chamber 326 of basket 320. Thus, controller 366 can correlate the magnitude of the first and/or second derivative of the angular velocity of basket 320 to the mass of articles within wash chamber 326 of basket 320. The controller 366 can also establish a tolerance range for the mass of articles within wash chamber 326 of basket 320. The tolerance range for the mass of articles within wash chamber 326 of basket 320 can correspond to the error or uncertainty of the estimate of the mass of articles within wash chamber 326 of basket 320.

Determining the load type may also include directing a volume of liquid into wash tub 324, e.g., by the controller 366. In particular, controller 366 may direct liquid into wash tub 324 until a level of liquid within wash tub 324 reaches a predetermined height, e.g., about six inches. The predetermined height may be detected or confirmed based on a pressure sensor in some embodiments. As an example, controller 366 can open a fill valve (not shown) in order to direct a flow of liquid into wash tub 324. After or when the level of liquid within wash tub 324 reaches the predetermined height, controller 366 can close valve in order to terminate the flow of liquid into wash tub 324. Controller 366 can calculate the volume of liquid within wash tub 324, e.g., based on a flow rate of liquid through valve and a time period between controller 366 opening and closing valve or with the use of a liquid flow meter (not shown).

The controller 366 may then establish the load type of articles within wash chamber 326 of basket 320, e.g., based at least in part on the estimated mass of articles within wash chamber 326 of basket 320 and the calculated volume of liquid.

Additionally, the absorptivity of the articles may be determined based on the volume of liquid, for example by using one or more predetermined volume-liquid level absorption correlations for various load types of articles within wash chamber 326 of basket 320 and the estimated mass of articles within wash chamber 326 of basket 320. As used herein, the term "volume-liquid level absorption correlation" corresponds to a relationship between the volume of liquid within wash tub 324 required to fill wash tub 324 to the predetermined height and the mass of articles within wash chamber 326 of basket 320. As an example, if articles within wash chamber 326 of basket 320 have a relatively high absorptivity, a relatively large volume of liquid can be required to fill wash tub 324 to the predetermined height. Conversely, for a load with an identical mass as the above example, a relatively small volume of liquid can be required to fill wash tub 324 to the predetermined height if articles within wash chamber 326 of basket 320 have a relatively low absorptivity. If a blended load of articles is disposed within wash chamber 326 of basket 320, a volume of liquid between the relatively large volume of liquid and the relatively small volume of liquid can be required to fill wash tub 324 to the predetermined height.

In some embodiments, controller 366 can provide the plurality of liquid volume-liquid level absorption correlations. For example, the plurality of liquid volume-liquid level absorption correlations can be established experimentally and may be stored in the memory of controller 366 during production of washing machine appliance 300. Each absorption correlation of the plurality of liquid volume-liquid level absorption correlations corresponds to a respective load type of articles within wash chamber 326 of basket 320. In some exemplary embodiments, the plurality of liquid volume-liquid level absorption correlations may include a cotton liquid volume-liquid level absorption correlation and a blended liquid volume-liquid level absorption correlation.

In some embodiments, controller 366 can also ascertain predicted masses of articles within wash chamber 326 of basket 320 based at least in part on the plurality of liquid volume-liquid level absorption correlations. Each predicted mass of the predicted masses of articles within wash chamber 326 of basket 320 may correspond to a respective one of the plurality of liquid volume-liquid level absorption correlations.

In some embodiments, controller 366 can also compare the estimated mass of articles within wash chamber 326 of basket 320 and the predicted masses of articles within wash chamber 326 of basket 320 (the estimated mass may be estimated, for example, based on the first and/or second derivative of the angular velocity of basket 320, as described above). In particular, controller 366 can determine differences between the estimated mass of articles within wash chamber 326 of basket 320 and the predicted masses of articles within wash chamber 326 of basket 320. Controller 366 can establish the load type of articles within wash chamber 326 of basket 320 based at least in part on the differences between the estimated mass of articles within wash chamber 326 of basket 320 and the predicted masses of articles within wash chamber 326 of basket 320.

In some embodiments, controller 366 can select a cotton load type, a blended load type, or a synthetic load type based at least in part on differences between the estimated mass of articles within wash chamber 326 of basket 320 and the predicted masses of articles within wash chamber 326 of basket 320. The differences between the estimated mass and the predicted masses may fall within a tolerance range of the mass of articles within wash chamber 326 of basket 320 for one of the possible load types, e.g., the differences between the estimated mass and the predicted masses may fall within the tolerance range of the predicted mass of articles within wash chamber 326 of basket 320 for one of the natural load type, the synthetic load type, or the blended load type.

In some embodiments, if any portion of the tolerance range of the mass of articles within wash chamber 326 of basket 320 is within the tolerance range of the predicted mass of articles within wash chamber 326 of basket 320 for the blended load type, controller 366 can establish the load type of articles within wash chamber 326 of basket 320 as the blended load type. Conversely, if the tolerance range of the mass of articles within wash chamber 326 of basket 320 is only within the tolerance range of the predicted mass of articles within wash chamber 326 of basket 320 for the natural load type, controller 366 can establish the load type of articles within wash chamber 326 of basket 320 as the natural load type. Similarly, if the entire tolerance range of the mass of articles within wash chamber 326 of basket 320 is greater than the tolerance range of the predicted mass of articles within wash chamber 326 of basket 320 for the blended load type, controller 366 can establish the load type of articles within wash chamber 326 of basket 320 as the synthetic load type.

Figure 5:
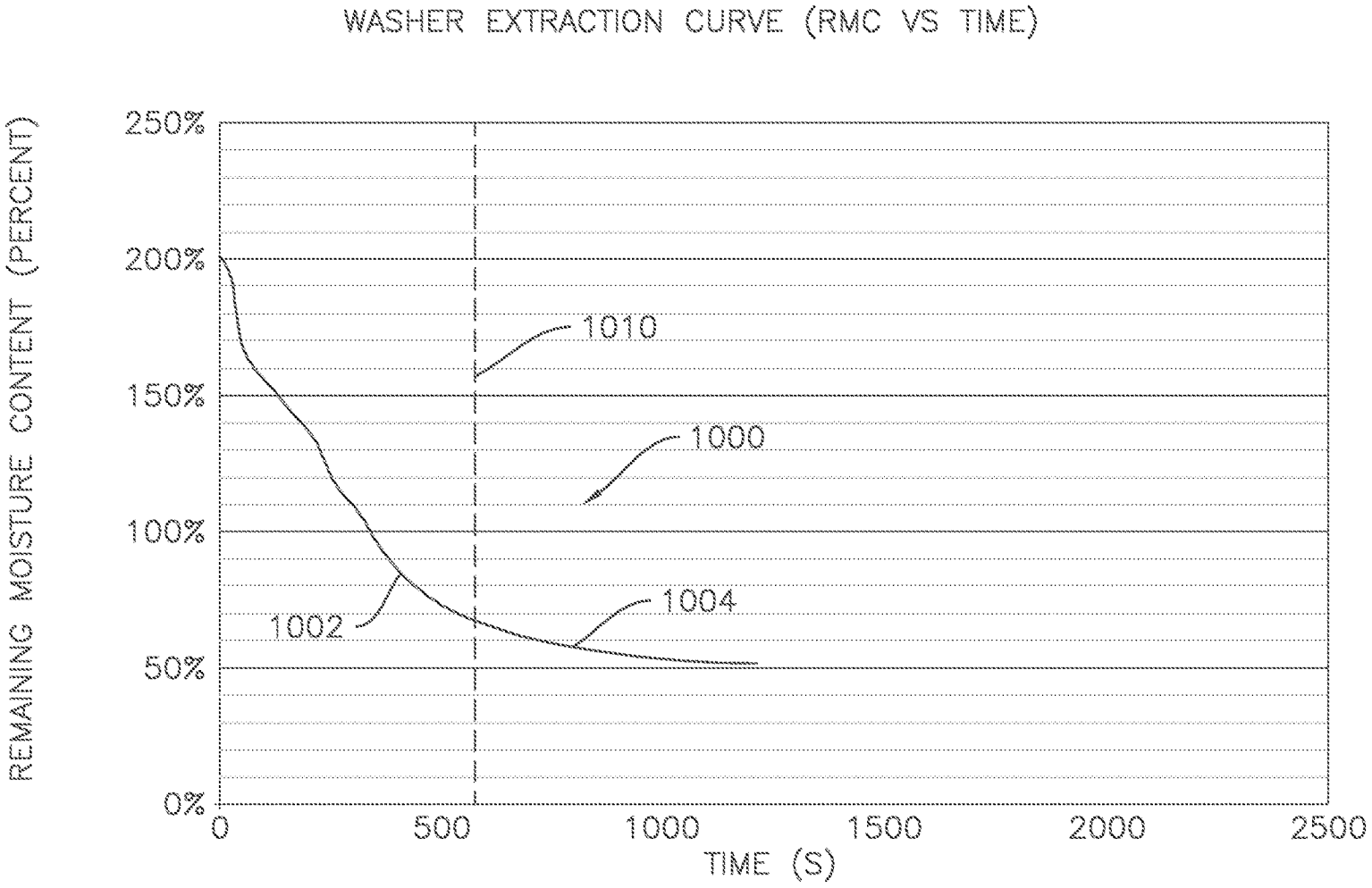
FIG. 5 illustrates an exemplary moisture extraction curve of a spin cycle of a washing machine appliance.

FIG. 5 illustrates a moisture extraction curve 1000, e.g., a graph of remaining moisture content versus time, for an exemplary spin cycle of an exemplary washing machine appliance, such as but not limited to washing machine appliance 300 of FIGS. 1 and 2. As may be seen in FIG. 5, the moisture extraction curve 1000 comprises a first phase 1002 and a second phase 1004, which are delineated by a transition 1010. The transition 1010 represents a point at which the spin cycle has reached diminishing returns, e.g., where the moisture extraction rate (slope of curve 1000) is less than a moisture extraction rate for the same load in a paired dryer appliance, as discussed below with reference to FIG. 6. For example, the total time of the spin cycle may be about twenty minutes, whereas the transition 1010 to a flatter (e.g., slower) moisture extraction rate may occur at about ten minutes into the spin cycle.

Figure 6:
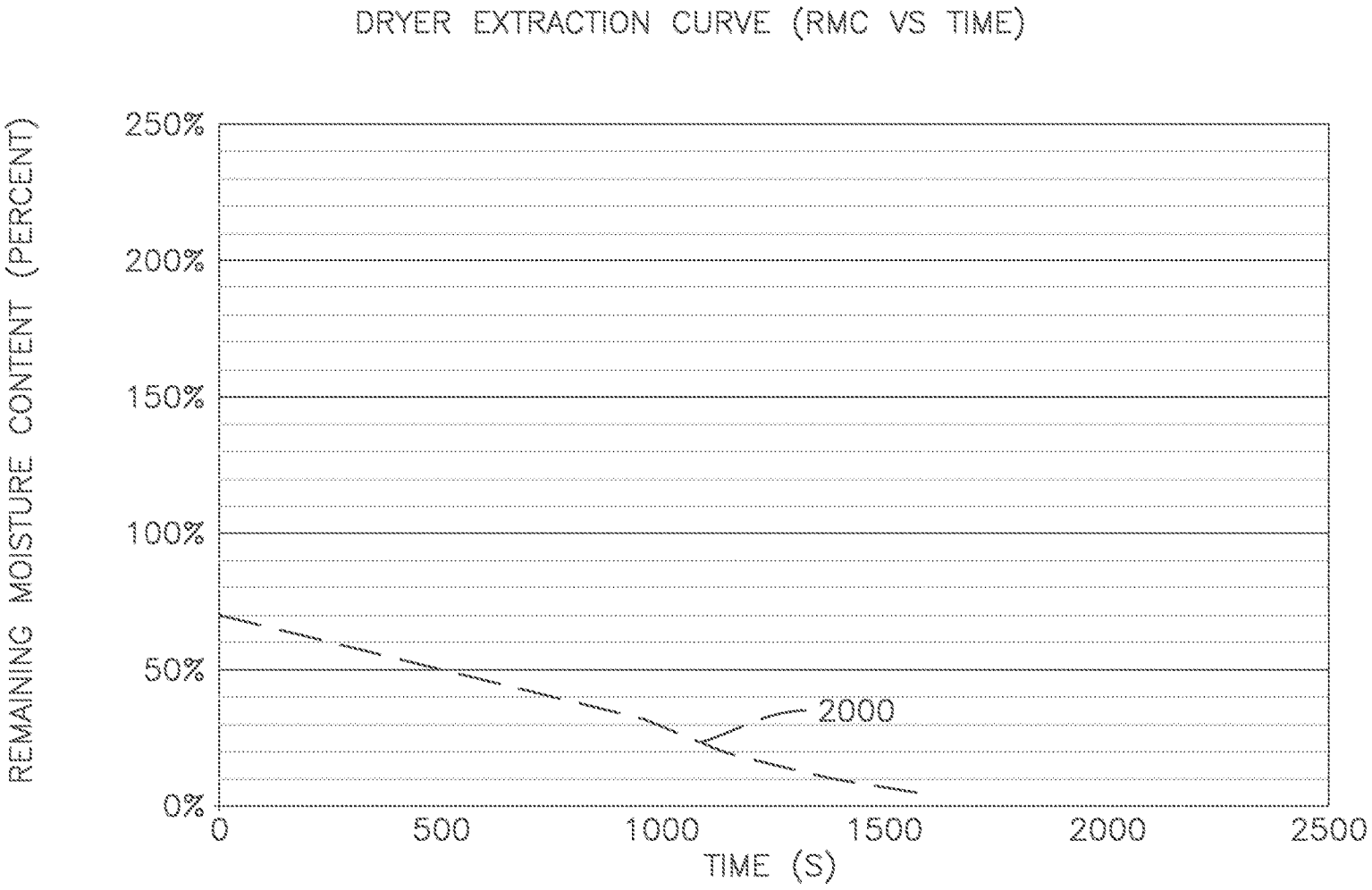
FIG. 6 illustrates an exemplary moisture extraction curve of a dryer appliance.

FIG. 6 illustrates a moisture extraction curve 2000, e.g., a graph of remaining moisture content versus time, for an exemplary dry operation of an exemplary dryer appliance, such as but not limited to dryer appliance 410 of FIGS. 3 and 4. The dryer appliance may be one of a pair of laundry appliances, e.g., may be paired with a washing machine appliance such as but not limited to washing machine appliance 300. As may be seen by comparing FIGS. 5 and 6, the dryer appliance has a more consistent moisture extraction rate, e.g., as indicated by the slope of moisture extraction curve 2000, than does the spin cycle of the washing machine appliance, e.g., as indicated by the more widely varying slope of curve 1000 in FIG. 5, but also the moisture extraction rate in the dryer is overall slower than the spin cycle of the washing machine appliance. In other words, the majority of the total moisture that is removed from the load of articles across the entire moisture extraction operation, e.g., the spin cycle in the washing machine appliance and the dry operation in the dryer appliance, is removed or extracted during the spin cycle, and in particular during the first phase of the spin cycle, e.g., which may, in some embodiments, correspond to first phase 1002 of the moisture extraction curve 1000. Over time, however, as the moisture extraction rate of the spin cycle decreases, e.g., where curve 1000 flattens, the dry operation in the dryer becomes preferable (e.g., more efficient and/or provides quicker moisture extraction) over the spin cycle. As may be seen from FIGS. 5 and 6, in some instances, the total moisture extraction time, e.g., the spin cycle time in the washing machine appliance plus the dry time in the dryer appliance, may be about forty-five minutes or longer, such as about an hour or longer. For example, the spin cycle in the washing machine appliance may take about twenty minutes or more, and the dry operation in the dryer appliance may take about twenty-five minutes or more, such as about thirty minutes or more, such as about forty-five minutes or more.

Figure 7:
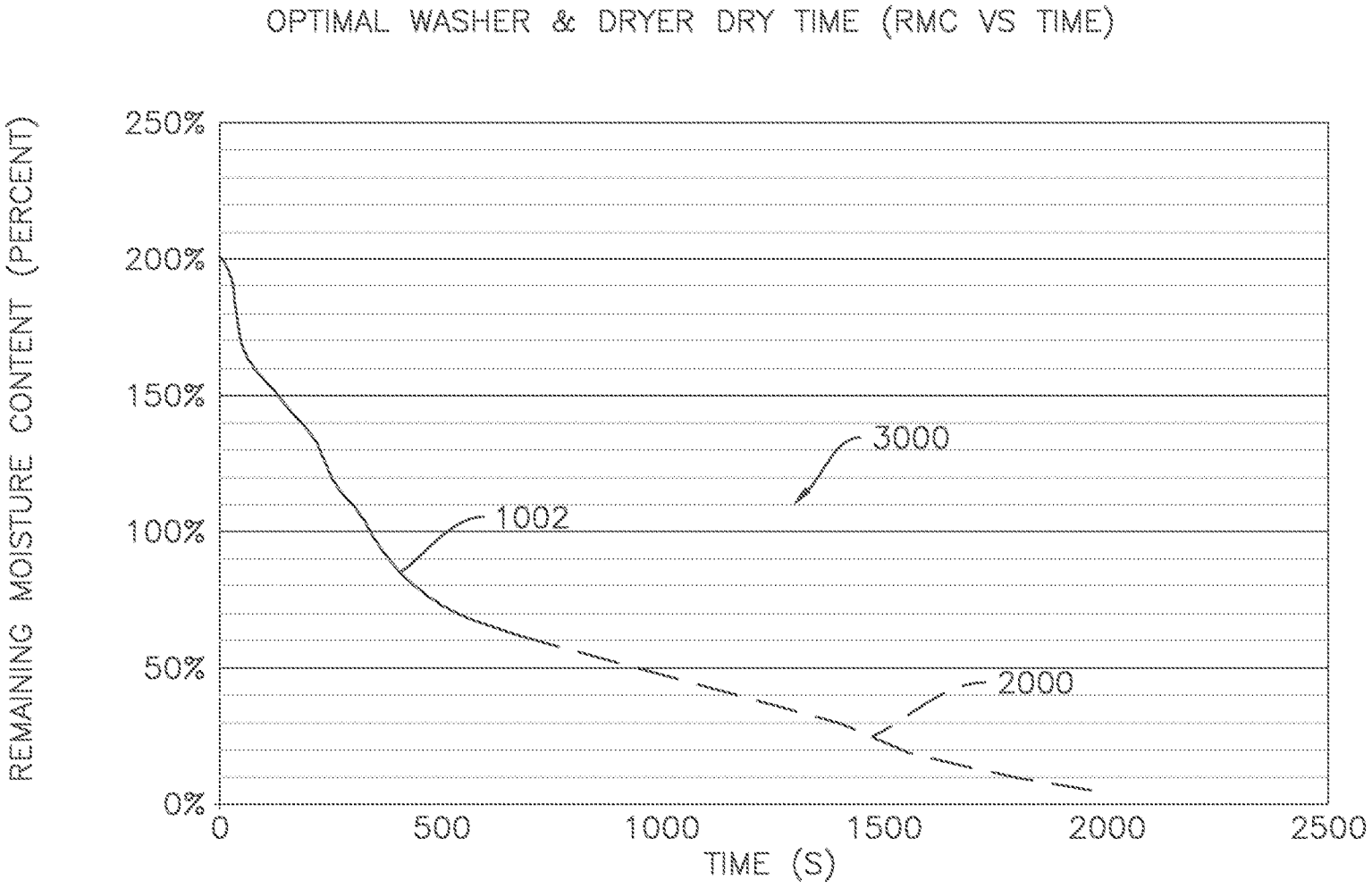
FIG. 7 illustrates an exemplary graph of remaining moisture content over time in a load of laundry articles throughout a moisture extraction operation across a pair of laundry appliances according to one or more exemplary embodiments of the present disclosure.

A moisture extraction curve 3000 for a combined moisture extraction operation across a pair of laundry appliances, e.g., a spin cycle in a washing machine appliance and a dry operation in a dryer appliance paired with the washing machine appliance, according to one or more exemplary embodiments of the present disclosure is illustrated in FIG. 7. As may be seen in FIG. 7, the combined moisture extraction curve 3000 includes the initial phase 1002 of the moisture extraction curve 1000 for the spin cycle followed by the moisture extraction curve 2000 for the dryer appliance, where (as discussed above) the portions or phases 1002 and 1004 of the curve 1000 are delineated by the transition 1010, e.g., the point at which the slope of the first moisture extraction curve 1000 is approximately equal to the slope of the second moisture extraction curve 2000. Accordingly, the combined moisture extraction operation corresponding to moisture extraction curve 3000 provides the same end result, e.g., the same ending remaining moisture content (sometimes also referred to as "RMC") of the load of articles, as the separate spin cycle and dry operation of FIGS. 5 and 6, while reaching that end result several minutes earlier. For example, the combined and optimized moisture extraction curve 3000 of FIG. 7 takes a total of about thirty minutes (e.g., about 1800 seconds, where "about" includes plus or minus ten percent, as noted above) as compared to about forty-five minutes for the non-optimized independent moisture extraction operations illustrated in FIGS. 5 and 6. In particular, by ending the spin cycle at or about the point where the slope of curve 1000 is generally equal to the slope of curve 2000, and thereby reducing the spin cycle time, the total time for moisture extraction from the load may be significantly reduced, e.g., by about one-third or about thirty-three percent. In the phrase "about the point where the slope of curve 1000 is generally equal to the slope of curve 2000" "about the point" means within about ten percent of the point in time where the slopes are equivalent, such as where the transition 1010 occurs at ten minutes or 600 seconds, within a range from 540 seconds to 660 seconds, and "generally equal" includes up to ten percent greater or less than.

Figure 8:
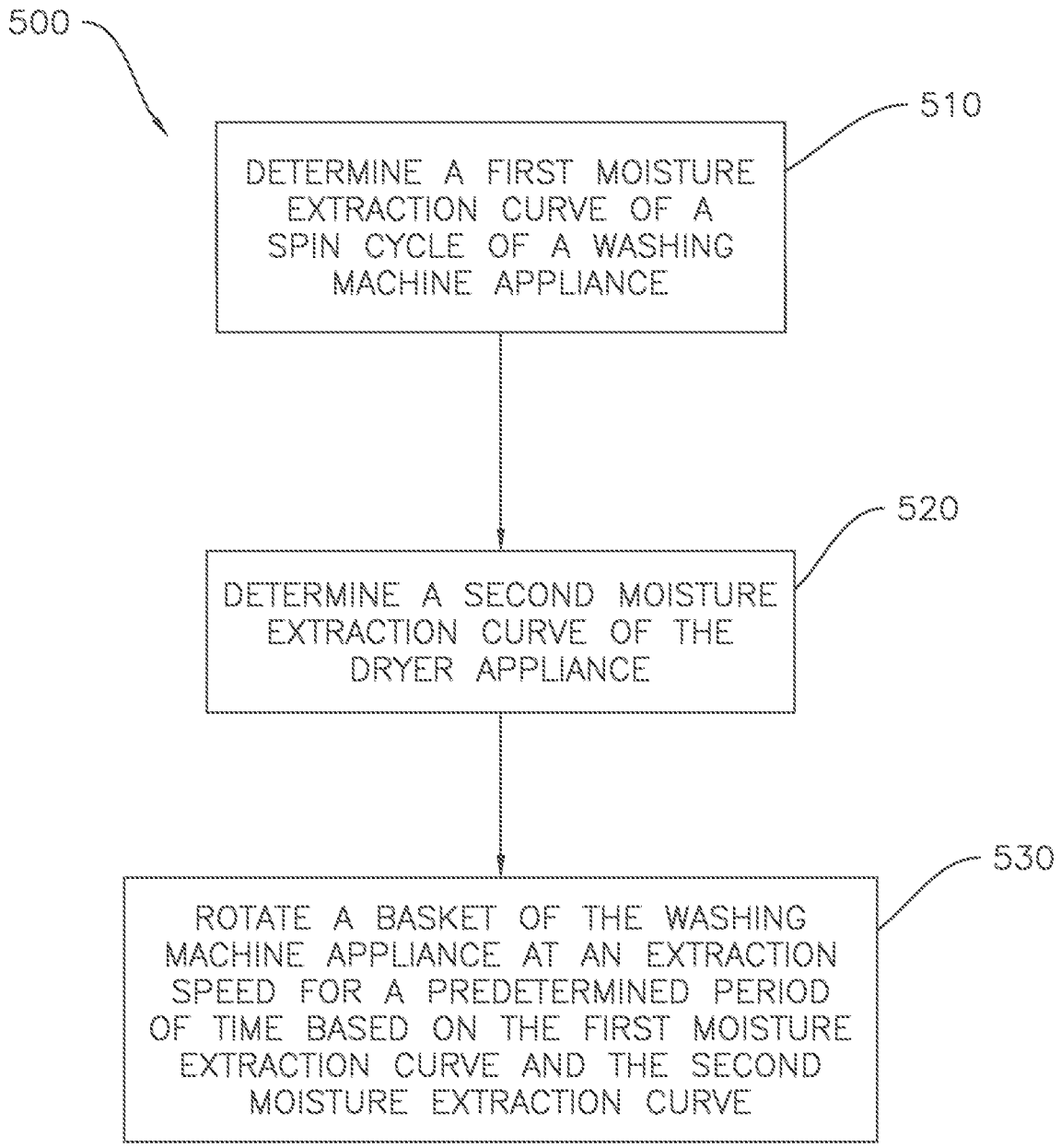
FIG. 8 provides a flow chart illustrating a method for operating a laundry appliance in accordance with one or more additional exemplary embodiments of the present disclosure.

FIG. 8 illustrates a method 500 for operating a pair of laundry appliances according to an exemplary embodiment of the present subject matter. Method 500 can be used to operate any suitable laundry appliances, such as a paired washing machine appliance and dryer appliance, e.g., washing machine appliance 300 of FIGS. 1 and 2 and dryer appliance 410 of FIGS. 3 and 4. In particular, controller 366 of washing machine appliance 300 and/or controller 490 of dryer appliance 410 may be programmed or configured to implement some or all of the steps of method 500.

As illustrated in FIG. 8, the method 500 may include a step 510 of determining a first moisture extraction curve of a spin cycle of the washing machine appliance, one example of such first moisture extraction curve being the curve 1000 in FIG. 5. For example, the washing machine appliance may include a humidity sensor or other moisture sensor and may, in some embodiments, measure, e.g., indirectly, the RMC in the articles based on the moisture in the air within the tub, e.g., the humidity. As another example, the washing machine appliance may be configured to determine, e.g., measure or estimate, a dry weight of the articles at the beginning of the wash cycle and to determine, e.g., measure or estimate, a plurality of saturated weight values of the load of articles during the spin cycle. In such example embodiments, the washing machine appliance may then determine the RMC based on the difference in weight of the articles over time (e.g., decreasing as moisture is extracted during the spin cycle) compared to the dry weight. For example, the controller 366 may have a fixed or known clock speed and/or the weight measurements may be taken at a fixed or known time interval in order to determine the time scale of the moisture extraction curve. In additional exemplary embodiments, the first moisture extraction curve may be determined based on one or more example loads or test loads, such as a test cotton load, a test blended load, and/or a test mixed load, and the first moisture extraction curve(s) for the various load types may be preprogrammed into a memory of the controller of the washing machine appliance, wherein the washing machine appliance may select or apply a moisture extraction curve corresponding to a selected load type, e.g., from a user input, or a measured load type based on the mass of the articles in the load and the absorbency of the articles in the load.

Still with reference to FIG. 8, the method 500 may further include a step 520 of determining a second moisture extraction curve of the dryer appliance, e.g., such as, in some embodiments, the curve 2000 of FIG. 6. For example, the dryer appliance may include a humidity sensor downstream of the chamber 425, such as in the exhaust duct 452, and the controller 490 may be configured to indirectly measure or estimate the RMC of the load of articles during the dry operation based on the sensed humidity, e.g., in the exhaust duct 452. As another example, the dryer appliance may include a pair of sensor rods positioned to contact the articles within the drum and to measure electrical resistance between the pair of sensor rods, where the electrical resistance will be greater when the article(s) bridging the gap between the sensor rods are more dry, e.g., when the RMC decreases the electrical conductivity decreases and/or electrical resistance increases. In further embodiments, the dryer may measure or estimate the RMC of the load of articles during the dry operation according to any suitable method. The moisture extraction curve of the dryer appliance may then be determined, e.g., using a clock circuit or internal clock of the controller, e.g., controller 490, for the time factor, such as based on the change in the indirectly measured or estimated RMC over time. In additional exemplary embodiments, the second moisture extraction curve may be preprogrammed into a memory of the controller of the dryer appliance, for example, the second moisture extraction curve may be a standard or default curve generated in a controlled environment, such as a factory or laboratory, and then programmed into the memory of the controller of the dryer appliance.

As mentioned above, the washing machine appliance and the dryer appliance may be paired, including communicatively coupled, such as in wireless communication or in communication via a wireless network or in direct wireless communication between the washing machine appliance and the dryer appliance. Thus, in various embodiments, the method 500 may include communicating the first and/or second moisture extraction curves to and/or from the washing machine appliance and the dryer appliance. For example, in some embodiments, the dryer appliance may be configured for determining the second moisture extraction curve and transmitting the second moisture extraction curve to the washing machine appliance. The washing machine appliance may, in some embodiments, be configured for determining the first moisture extraction curve and for receiving the second moisture extraction curve from the dryer appliance. In such embodiments, the washing machine appliance may then compare the first moisture extraction curve and the second moisture extraction curve, determine the point at or about which the slope of the first moisture extraction curve is generally equal to the slope of the second moisture extraction curve, and stop the spin cycle at the determined point. For example, in such embodiments, the washing machine appliance, e.g., the controller thereof, may calculate a predetermined period of time (such as a period of time ending at the determined point) over which to perform the spin cycle based on the comparison of the first moisture extraction time and the second moisture extraction time.

In additional embodiments, the pair of laundry appliances may be in indirect communication, such as via one or more wireless networks and/or a remote database such as a cloud server. In such embodiments, the remote database or server may receive each of the first and second moisture extraction curves, compare the received curves, and determine the transition point at or about which the slope of the first moisture extraction curve is generally equal to the slope of the second moisture extraction curve. The remote database or server may then transmit the results of such comparison and determination, e.g., a predetermined stop time at which to stop the spin cycle of the washing machine appliance or a predetermined period of time over which to perform the spin cycle of the washing machine appliance, to the washing machine appliance, whereafter the washing machine appliance may then perform a spin cycle, e.g., including rotating a basket of the washing machine appliance at an extraction speed, for the predetermined period of time and/or until the predetermined stop time.

Thus, in various embodiments, the method 500 may further include a step 530 of rotating a basket of the washing machine appliance at an extraction speed for a predetermined period of time. As mentioned, the predetermined period of time may be based on the first moisture extraction curve and the second moisture extraction curve, such as based on a comparison of the first moisture extraction curve and the second moisture extraction curve, such as identifying a point at or about which the slope of the first moisture extraction curve is generally equal to the slope of the second moisture extraction curve. Such comparison may be performed by one or both laundry appliances of the pair of laundry appliances, and/or by a remote database or cloud server, and/or by a remote device such as a smartphone or tablet, e.g., in an appliances software or appliances "app" running on the remote device.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a pair of laundry appliances comprising a washing machine appliance and a dryer appliance, the method comprising:

determining a first moisture extraction curve of remaining moisture content over time of a spin cycle of the washing machine appliance;

determining a second moisture extraction curve of remaining moisture content over time of the dryer appliance; and rotating a basket of the washing machine appliance at an extraction speed for a predetermined period of time, the predetermined period of time based on the first moisture extraction curve and the second moisture extraction curve.

2. The method of claim 1, wherein the predetermined period of time corresponds to the time at which a slope of the first moisture extraction curve is approximately equal to a slope of the second moisture extraction curve.

3. The method of claim 1, wherein the second moisture extraction curve is preprogrammed into a memory of a controller of the dryer appliance.

4. The method of claim 3, wherein the washing machine appliance is communicatively coupled with the dryer appliance, the method further comprising transmitting the second moisture extraction curve to the washing machine appliance from the dryer appliance and receiving the second moisture extraction curve from the dryer appliance by the washing machine appliance.

5. The method of claim 1, wherein the step of determining the first moisture extraction curve is performed by the washing machine appliance and is based on a load of articles within a basket of the washing machine appliance.

6. The method of claim 5, wherein determining the first moisture extraction curve by the washing machine appliance is based on a load type of the load of articles within the basket, and wherein the load type is determined based on mass of the articles and absorbency of the articles.

7. The method of claim 5, wherein the second moisture extraction curve is preprogrammed into a memory of a controller of the dryer appliance.

8. The method of claim 7, wherein the washing machine appliance is communicatively coupled with the dryer appliance, the method further comprising transmitting the second moisture extraction curve to the washing machine appliance from the dryer appliance and receiving the second moisture extraction curve from the dryer appliance by the washing machine appliance.

9. The method of claim 8, further comprising comparing, by a controller of the washing machine appliance, the first moisture extraction curve determined by the washing machine appliance with the second moisture extraction curve received from the dryer appliance, and determining the predetermined period of time, by the controller of the washing machine appliance, based on the comparison of the first moisture extraction curve with the second moisture extraction curve.

10. A pair of laundry appliances comprising a washing machine appliance and a dryer appliance, the pair of laundry appliances configured to:

determine a first moisture extraction curve of remaining moisture content over time of a spin cycle of the washing machine appliance;

determine a second moisture extraction curve of remaining moisture content over time of the dryer appliance; and rotate a basket of the washing machine appliance at an extraction speed for a predetermined period of time, the predetermined period of time based on the first moisture extraction curve and the second moisture extraction curve.

11. The pair of laundry appliances of claim 10, wherein the predetermined period of time corresponds to the time at which a slope of the first moisture extraction curve is approximately equal to a slope of the second moisture extraction curve.

12. The pair of laundry appliances of claim 10, wherein the second moisture extraction curve is preprogrammed into a memory of a controller of the dryer appliance.

13. The pair of laundry appliances of claim 12, wherein the washing machine appliance is communicatively coupled with the dryer appliance, whereby the dryer appliance is configured to transmit the second moisture extraction curve to the washing machine appliance and the washing machine appliance is configured to receive the second moisture extraction curve from the dryer appliance.

14. The pair of laundry appliances of claim 10, wherein the washing machine appliance is configured to determine the first moisture extraction curve based on a load of articles within a basket of the washing machine appliance.

15. The pair of laundry appliances of claim 14, wherein the washing machine appliance is configured to determine the first moisture extraction curve based on a load type of the load of articles within the basket, and wherein the load type is determined based on mass of the articles and absorbency of the articles.

16. The pair of laundry appliances of claim 14, wherein the second moisture extraction curve is preprogrammed into a memory of a controller of the dryer appliance.

17. The pair of laundry appliances of claim 16, wherein the washing machine appliance is communicatively coupled with the dryer appliance, whereby the dryer appliance is configured to transmit the second moisture extraction curve to the washing machine appliance and the washing machine appliance is configured to receive the second moisture extraction curve from the dryer appliance.

18. The pair of laundry appliances of claim 17, wherein the controller of the washing machine appliance is configured to compare the first moisture extraction curve determined by the washing machine appliance with the second moisture extraction curve received from the dryer appliance, and to determine the predetermined period of time based on the comparison of the first moisture extraction curve with the second moisture extraction curve.

* * * * *